US005977848A

United States Patent [19]

Nakaguchi et al.

[11] Patent Number: 5,977,848

[45] Date of Patent: Nov. 2, 1999

[54] POLAR DIELECTRIC FILTER AND DIELECTRIC DUPLEXER INCORPORATING SAME

[75] Inventors: Masahisa Nakaguchi, Katano; Takaaki Uchiyama, Higashiosaka, both of Japan

[73] Assignee: Sanyo Electric Co., Ltd., Moriguchi, Japan

[21] Appl. No.: 08/982,582

[22] Filed: Dec. 2, 1997

[30] Foreign Application Priority Data

Dec. 3, 1996 [JP] Japan ..... 8-322463

[51] Int. Cl.[6] ..... H01P 1/205

[52] U.S. Cl. ..... 333/206; 333/134

[58] Field of Search ..... 333/202, 206, 333/207, 222, 134, 126

[56] References Cited

U.S. PATENT DOCUMENTS

| | | | |
|---|---|---|---|
| 4,673,902 | 6/1987 | Takeda et al. | 333/206 X |
| 5,365,209 | 11/1994 | Ito et al. | 333/206 |
| 5,402,090 | 3/1995 | Shimizu et al. | 333/206 |
| 5,499,004 | 3/1996 | Noguchi et al. | 333/206 X |
| 5,534,829 | 7/1996 | Kobayashi et al. | 333/206 X |
| 5,546,059 | 8/1996 | Yorita et al. | 333/206 X |
| 5,572,175 | 11/1996 | Tada et al. | 333/206 |
| 5,783,978 | 7/1998 | Noguchi et al. | 333/206 X |

FOREIGN PATENT DOCUMENTS

| | | | |
|---|---|---|---|
| 57-65002 | 4/1982 | Japan | 333/206 |
| 8-195602 | 7/1996 | Japan | 333/206 |

*Primary Examiner*—Seungsook Ham

*Attorney, Agent, or Firm*—Armstrong, Westerman, Hattori, McLeland & Naughton

[57] ABSTRACT

A polar band-pass dielectric filter including three coaxial dielectric resonators each including a main body in the form of a dielectric member, the main body being formed with a through bore extending through opposite end faces thereof, the main body having an outer conductor layer provided over an outer peripheral surface thereof and an inner conductor layer over an inner surface thereof defining the through bore. The resonators are joined to one another with one side of an outer periphery surface of each resonator serving as a joint surface. Each of the resonators has an electrode insulated from the outer conductor layer and provided at a portion of the outer peripheral surface thereof other than the joint surface. The electrodes of the resonators are connected together by a substantially straight conductor member.

12 Claims, 8 Drawing Sheets

POLAR DIELECTRIC FILTER AND DIELECTRIC DUPLEXER INCORPORATING SAME

BACKGROUND OF THE INVENTION

1. Field of the Invention

The present invention relates to dielectric filters and dielectric duplexers for use with high-frequency signals at hundreds of megahertz to a few gigahertz, and more particularly to polar dielectric filters having a sharp attenuation pole in pass characteristics and dielectric duplexers having such a filter incorporated therein.

2. Description of the Related Art

Various high-frequency filters are used in communications devices. Filters of reduced sizes and improved characteristics are especially required with prevalent use of portable telephones and like mobile communications devices. The conventional filters for use at high frequencies include dielectric filters comprising coaxial dielectric resonators.

Coaxial dielectric resonators comprise a main body formed by a dielectric member and having a through bore extending through opposite end faces of the body and a conductor layer formed over the outer peripheral surface of the main body and over the inner surface of the body defining the bore. Electromagnetic waves are caused to undergo resonance within the main body of the device. When one of the end faces is provided with a conductor layer, the main body provides a ¼ wavelength resonator. When both end faces are provided with the conductor layer or neither of the end faces has the layer, the main body provides a ½ wavelength resonator.

With reference to an equivalent circuit shown in FIG. 7*a,* a plurality of coaxial dielectric resonators 1*a,* 1*b,* 1*c* can be assembled into a band-pass filter by capacitively coupling these resonators as arranged in parallel to provide interstage coupling capacitances $C_1$, $C_2$, and capacitively coupling external input and output terminals 40, 41 to the resonators 1*a,* 1*c* at opposite ends of the parallel arrangement to form input and output coupling capacitances $C_{IN}$, $C_{OUT}$.

The band-pass filter can be modified to a polar filter having sharp attenuation characteristics involving an attenuation pole as seen in FIG. 8 by providing a series resonance capacitance $C_3$ for one of the coaxial dielectric resonators 1*a,* 1*b,* 1*c* as shown in FIG. 7*b.*

FIG. 9 shows a conventional polar filter having the equivalent circuit of FIG. 7*b* and comprising three coaxial dielectric resonators 1*a,* 1*b,* 1*c* mounted on a substrate 6. External input and output terminals 40, 41 are disposed on the substrate 6 for electric signals to be transmitted to or received from external devices. The inner conductor layers formed in the through bores of the resonators 1*a,* 1*b,* 1*c* are connected by metal terminals 9*a,* 9*b,* 9*c* to respective conductor patterns formed on the substrate 6.

The input terminal 40 is connected to the resonator 1*a* serving as an input stage by way of an input coupling capacitor 80. The input-stage resonator 1*a* is connected to the resonator 1*b* providing an intermediate stage via an interstage coupling capacitor 81 and series resonance capacitor 83. The intermediate-stage resonator 1*b* is connected to the resonator 1*c* serving as an output stage via the series resonance capacitor 83 and an interstage coupling capacitor 82. The output-stage resonator 1*c* is connected to the output terminal 41 via an output coupling capacitor 84.

The conventional filter described requires, in addition to the resonators 1*a,* 1*b,* 1*c* and the substrate 6, a large number of external parts including the capacitors 80, 81, 82, 83, 84 and the metal terminals 9*a,* 9*b,* 9*c,* and many assembling steps, and is consequently large-sized.

An object of the present invention is to provide a polar dielectric filter which comprises coaxial dielectric resonators each having an electrode capacitively coupled to the inner conductor layer thereof so as to reduce the number of external parts conventionally needed.

SUMMARY OF THE INVENTION

To fulfill the above object, the present invention provides a dielectric filter comprising three coaxial dielectric resonators each including a main body in the form of a dielectric member, the main body being formed with a through bore extending through opposite end faces thereof, the main body having an outer conductor layer provided over an outer peripheral surface thereof and an inner conductor layer over an inner surface thereof defining the through bore, the resonators being joined to one another with one side of an outer periphery surface of each resonator serving as a joint surface, each of the resonators having an electrode insulated from the outer conductor layer and provided at a portion of the outer peripheral surface thereof other than the joint surface, the electrodes of the resonators being connected together by a conductor member having a substantially straight form.

The electrodes provided on the respective resonators are capacitively coupled to the respective inner conductor layers defining the through bores. With the electrodes connected together by the conductor member, the electrode coupled to the inner conductor layer of the resonator in the second stage is capacitively coupled to the inner conductor layers of the resonators in the first stage and the third stage by way of the conductor member and the electrodes of the first-stage and third-stage resonators. Thus, the coupling capacitances of the first-stage and third- stage resonators can be regarded as interstage coupling capacitances $C_1$, $C_2$ between the second-stage resonator and these resonators, and the coupling capacitance of the second-stage resonator as a series resonance capacitance $C_3$. Using known means, an external input terminal is capacitively coupled to the inner conductor layer of the first-stage resonator as an input stage to provide an input coupling capacitance $C_{IN}$, and an external output terminal is capacitively coupled to the inner conductor layer of third-stage resonator as an output stage to provide an output coupling capacitance $C_{OUT}$. The equivalent circuit of the dielectric filter then becomes equivalent to the circuit shown in FIG. 7*b,* rendering the filter serviceable as a polar dielectric filter.

Consequently, the resonators provide a polar filter without using external parts such as metal terminals, interstage coupling capacitors and series resonance capacitor. This results in a reduced number of components and smaller number of assembling steps, further diminishing the space needed for the installation of the filter in devices.

DETAILED DESCRIPTION OF THE INVENTION

Embodiments of the invention will be described below in detail with reference to the drawings.

Embodiment 1

Figure 1:
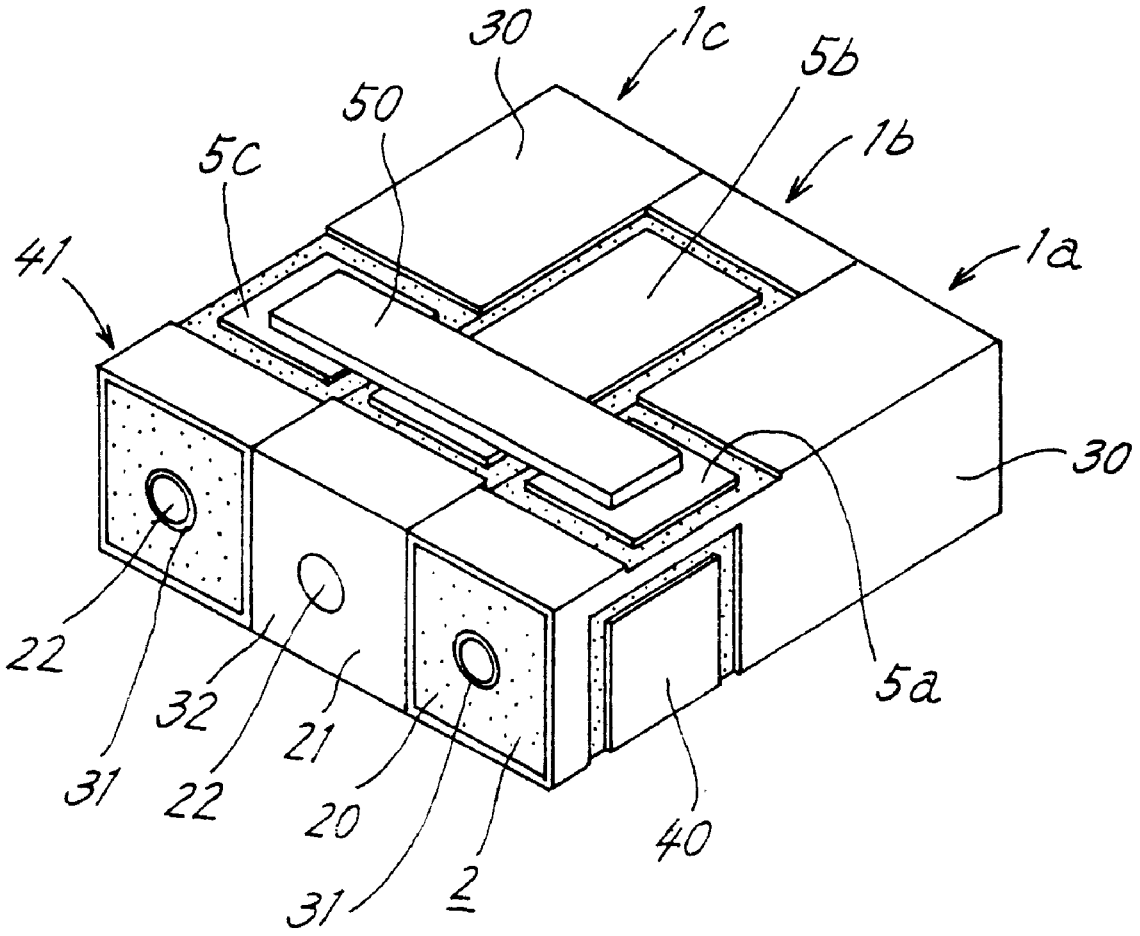
FIG. 1 is a perspective view showing a polar dielectric filter as a first embodiment.

FIG. 1 shows a first embodiment, i.e., a dielectric filter which comprises three coaxial dielectric resonators 1*a,* 1*b,* 1*c* and a conductor member 50.

Each of the resonators 1*a,* 1*b,* 1*c* is a ¼ wavelength resonator, which comprises a main body 2 in the form of a prismatic dielectric member and having a through bore 22 extending through opposite end faces 20, 21 thereof. An electrically conductive material covers the outer peripheral surface of the main body 2, the inner surface of the main body 2 defining the through bore 22, and one of the end faces of the main body 2, i.e., the end face 21, to provide conductive layers 30, 31, 32, respectively. The resonators 1*a,* 1*b,* 1*c* have respective electrodes 5*a,* 5*b,* 5*c* each insulated from the outer conductor layer 30 and formed on the upper side by cutting away the layer 30 in the form of a frame. The resonators 1*a,* 1*c* in the first stage and the third stage serving as the input stage and the output stage, respectively, have respective input and output coupling electrodes each insulated from the outer conductor layer 30 and formed on a lateral side by cutting away the layer 30 in the form of a frame. These electrodes serve as external input and output terminals 40, 41.

These three coaxial dielectric resonators 1*a,* 1*b,* 1*c* are joined as arranged side by side. The conductor member 50 having a substantially straight form is disposed on the electrodes 5*a,* 5*b,* 5*c* of the resonators 1*a,* 1*b,* 1*c* for connecting the electrodes 5*a,* 5*b,* 5*c* together.

Examples of suitable materials for the main bodies 2 are ceramics of high dielectric constant, such as barium oxide, titanium oxide and neodymium oxide. Suitable as the material for the conductor member 50 and as the conductive material is a material of high electric conductivity, such as silver or copper.

With the resonators 1*a,* 1*b,* 1*c* having the structure described above, the electrodes 5*a,* 5*b,* 5*c* thereof are capacitively coupled to the respective inner conductor layers 31 defining the through bores. With the electrodes 5*a,* 5*b,* 5*c* connected together by the conductor member 50, the electrode 5*b* coupled to the inner conductor layer 31 of the resonator 1*b* in the second stage is capacitively coupled to the inner conductor layers 31 of the resonators 1*a,* 1*c* in the first stage and the third stage by way of the conductor member 50 and the electrodes 5*a,* 5*c* of these resonators 1*a,* 1*c*. Thus, the coupling capacitances of the first- stage and third-stage resonators 1*a,* 1*c* can be regarded as interstage coupling capacitances $C_1$, $C_2$ between the second-stage resonator 1*b* and these resonators, and the coupling capacitance of the second-stage resonator 1*b* as a series resonance capacitance $C_3$. Further in the first-stage resonator 1*a* serving as the input stage, the external input terminal 40 is capacitively coupled to the inner conductor layer 31 to provide an input coupling capacitance $C_{IN}$. In the third-stage resonator 1*c* serving as the output stage, the external output terminal 41 is capacitively coupled to the inner conductor layer 31, providing an output coupling capacitance $C_{OUT}$.

Figure 7A:
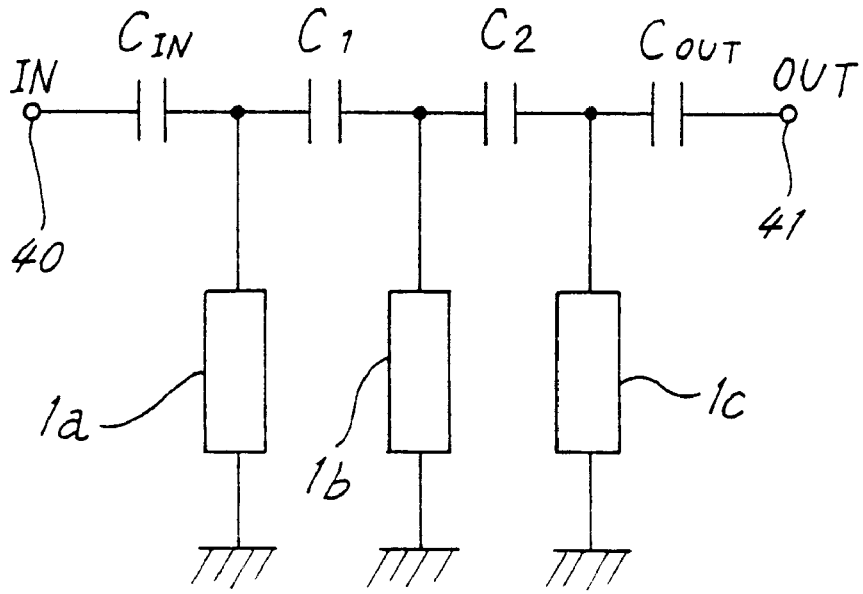
FIG. 7*a* is an equivalent circuit diagram of a common band-pass dielectric filter.
Figure 7B:
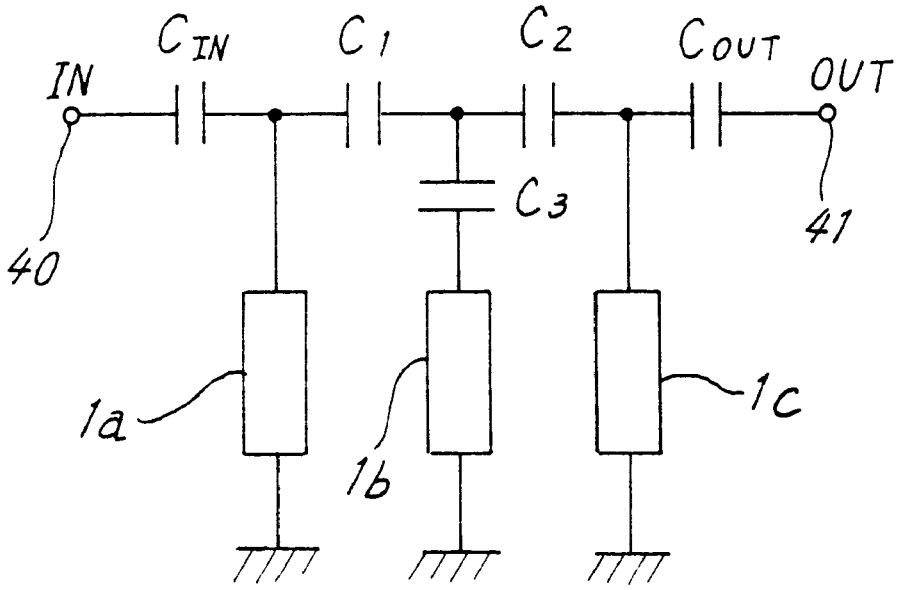
FIG. 7*b* is an equivalent circuit diagram of a polar dielectric filter having an attenuation pole in the pass characteristics of dielectric filters.
Figure 8:
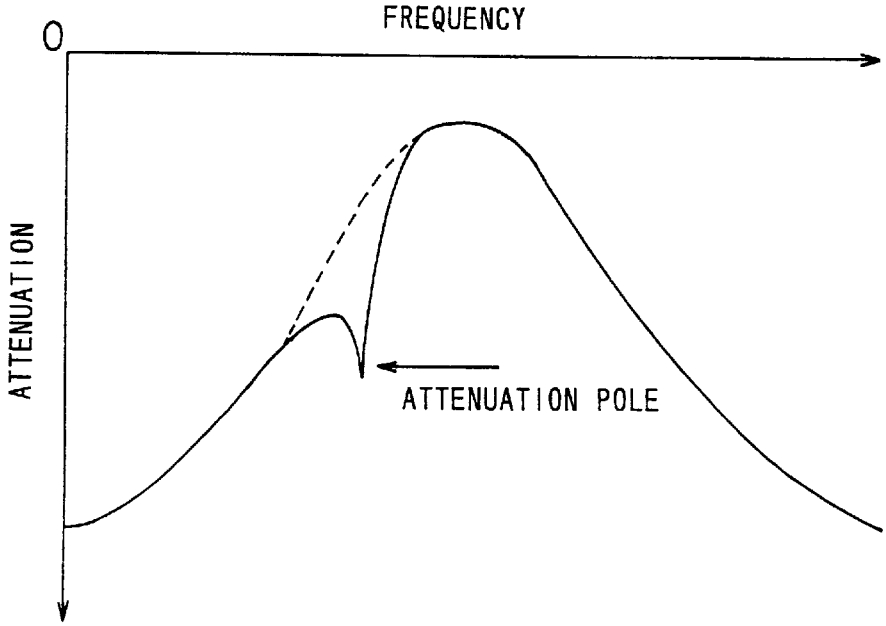
FIG. 8 is a diagram showing the pass characteristics of the polar dielectric filter shown in FIG. 7*b.
Figure 9:
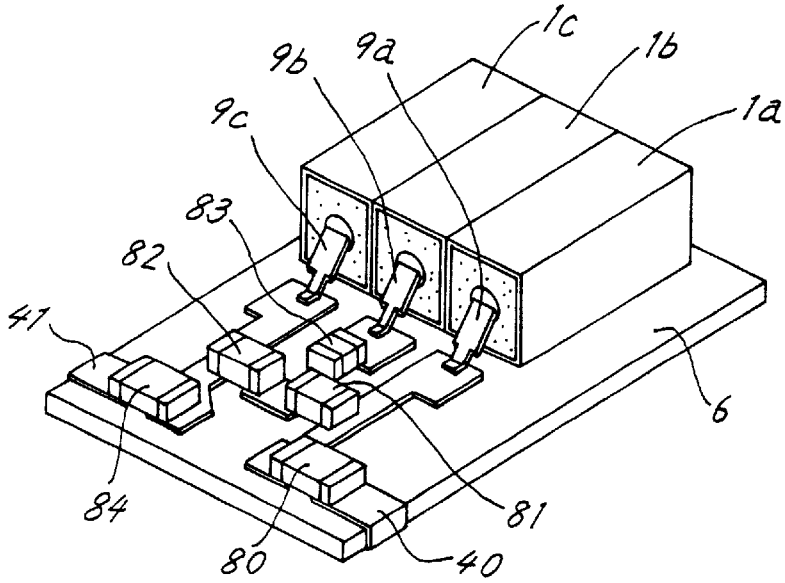
FIG.9 PRIOR ART
* and FIG. 9 is a perspective view of a conventional polar dielectric filter.

Accordingly, the dielectric filter has the same equivalent circuit as is shown in FIG. 7*b,* and is serviceable as a polar dielectric filter.

Consequently, the resonators provide a polar filter without using external parts such as metal terminals, interstage coupling capacitors and series resonance capacitor and further without necessitating a substrate. This reduces the number of components and the number of assembling steps and diminishes the space needed for the installation of the filter in devices.

Further because the inner conductor layer of the resonator is capacitively coupled to the electrode thereof, the value of the coupling capacitance is variable easily by altering the shape or size of the electrode. The filter can therefore be readily given the desired pass characteristics.

Embodiment 2

Figure 2A:
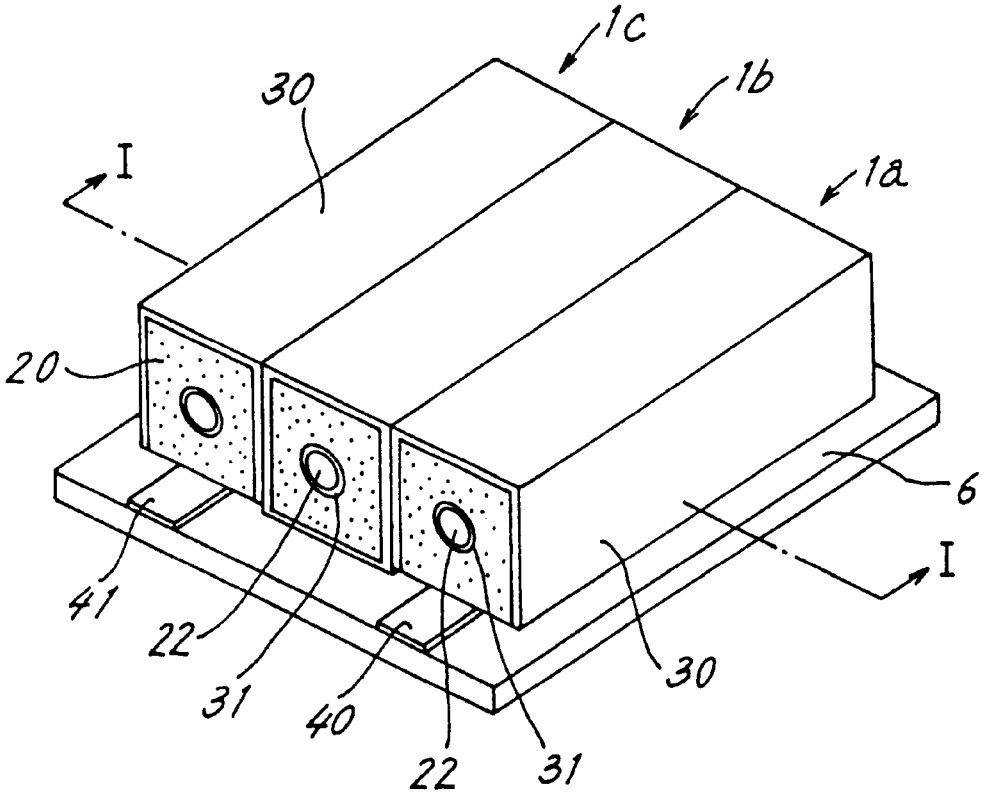
FIG. 2*a* is a perspective view showing another polar dielectric filter as a second embodiment.
Figure 2B:
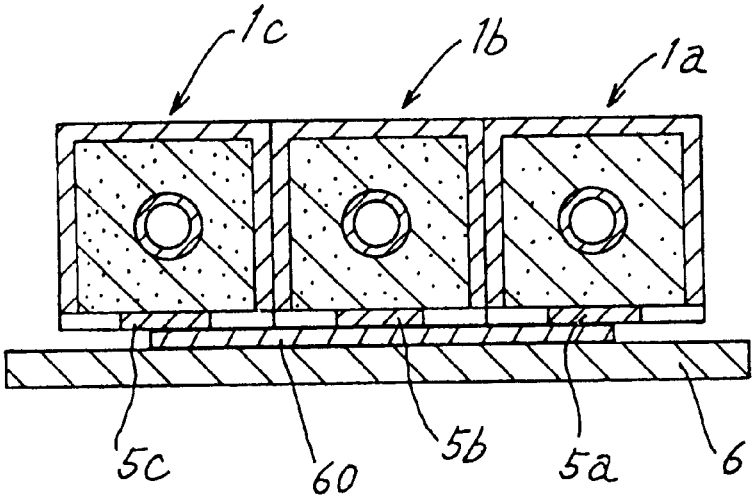
FIG. 2*b* is a view in vertical section taken along the line I—I in FIG. 2*a* and showing the filter as it is seen in the direction of the arrows.

FIGS. 2*a* and 2*b* show a second embodiment, i.e., a dielectric filter which comprises three coaxial dielectric resonators 1*a,* 1*b,* 1*c,* and a substrate 6 formed with a conductor pattern.

Figure 3A:
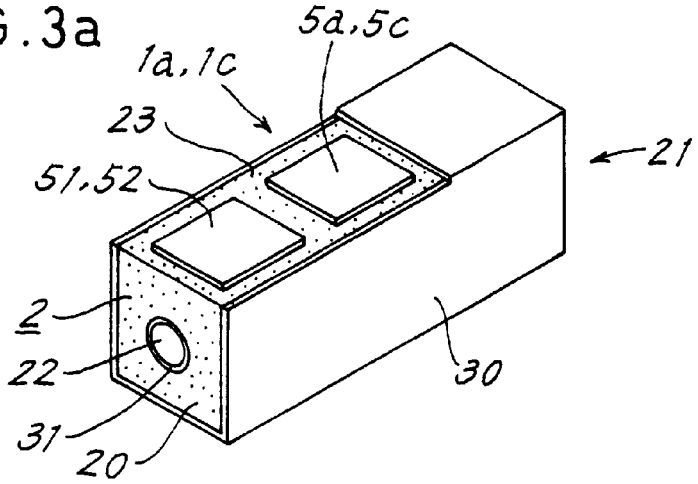
FIG. 3*a* is a perspective view showing a coaxial dielectric resonator included in the second embodiment and providing an input stage or output stage.
Figure 3B:
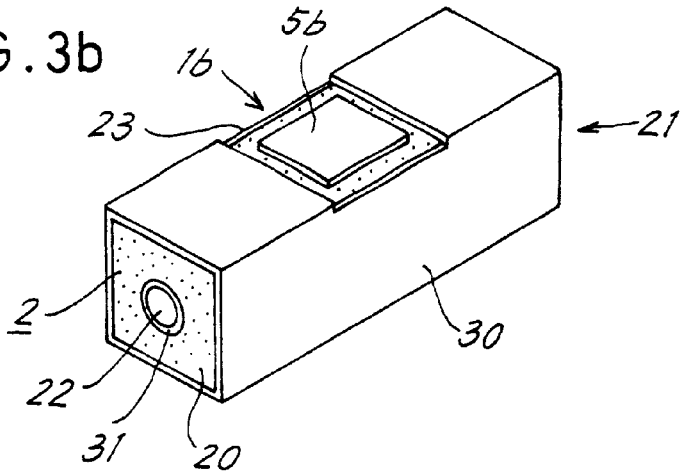
FIG. 3*b* is a perspective view showing a coaxial dielectric resonator included in the second embodiment and providing an intermediate stage.

With reference to FIGS. 3*a* and 3*b,* the resonators 1*a,* 1*b,* 1*c* are ¼ wavelength resonators which are prepared in the same manner as in the first embodiment and which have respective electrodes 5*a,* 5*b,* 5*c* each formed on the bottom side 23 thereof by partly cutting away the outer conductor layer 30 and thereby insulated from the layer 30. The resonators 1*a,* 1*c* in the first stage and the third stage providing an input stage and output stage, respectively, have respective input and output coupling electrodes 51, 52 each formed on the bottom side 23 thereof close to the open end 20 by partly cutting away the outer conductor layer 30 and thereby insulated from the layer 30.

The materials used for the resonators 1*a,* 1*b,* 1*c* are the same as in the first embodiment.

Figure 3C:
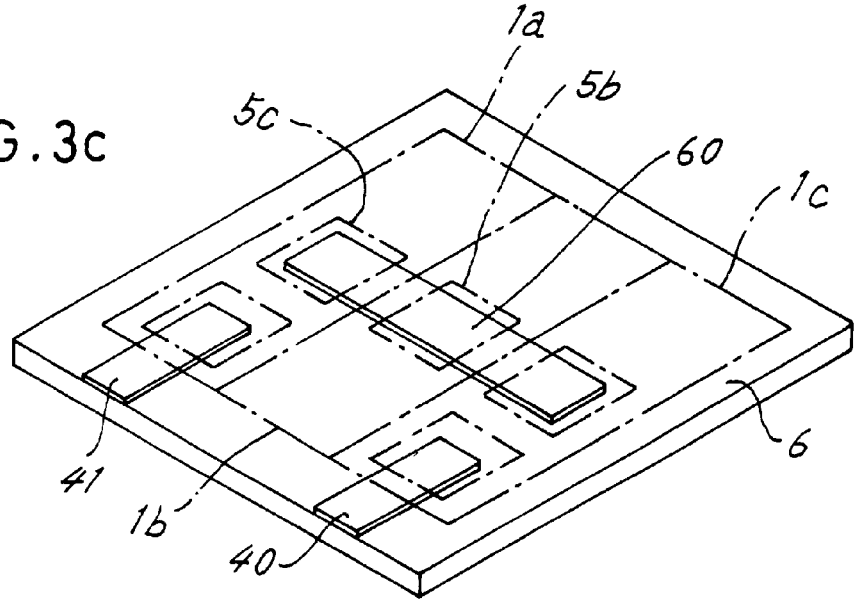
FIG. 3*c* is a perspective view showing a substrate for use in the second embodiment.

As shown in FIG. 3*c,* the substrate 6 is formed with a substantially straight conductor pattern 60 positioned in contact with the electrodes 5*a,* 5*b,* 5*c* of the resonators 1*a,* 1*b,* 1*c* for connecting these electrodes 5*a,* 5*b,* 5*c*. The substrate 6 also has input and output terminal patterns 40, 41 positioned in contact with the respective input and output coupling electrodes 51, 52 and extending from these positions to an edge of the substrate 6.

An insulating material such as alumina, glass-epoxy resin is used for the substrate 6.

The three coaxial dielectric resonators 1*a,* 1*b,* 1*c* are arranged on the substrate 6 bearing the conductor patterns 40, 41, 60 described. The electrodes 5*a,* 5*b,* 5*c* are electrically connected to the conductor pattern 60 as by substantially straight soldering, the input coupling electrode 51 is similarly connected to the input terminal pattern 40, and the output coupling electrode 52 to the output terminal pattern 41.

With the resonators 1*a,* 1*b,* 1*c* having the structure described above, the electrodes 5*a,* 5*b,* 5*c* thereof are capacitively coupled to the respective inner conductor layers 31 in the through bores. With the electrodes 5*a,* 5*b,* 5*c* connected together by the conductor pattern 60 on the substrate 6, the electrode 5*b* coupled to the inner conductor layer 31 of the resonator 1*b* in the second stage is capacitively coupled to the inner conductor layers 31 of the resonators 1*a,* 1*c* in the first stage and the third stage by way of the conductor pattern 60 and the electrodes 5*a,* 5*c* of these resonators 1*a,* 1*c*. Thus, the coupling capacitances of the first-stage and third- stage resonators 1*a,* 1*c* can be regarded as interstage coupling capacitances $C_1$, $C_2$ between the second-stage resonator 1*b* and these resonators, and the coupling capacitance of the second-stage resonator 1*b* as a series resonance capacitance $C_3$. Further in the first-stage resonator 1*a* serving as the input stage, the input coupling electrode 51 connected to the input terminal pattern 40 is capacitively coupled to the inner conductor layer 31 to provide an input coupling capacitance $C_{IN}$. In the third-stage resonator 1*c* serving as the output stage, the output coupling electrode 52 connected to the output terminal pattern 41 is capacitively coupled to the inner conductor layer 31, providing an output coupling capacitance $C_{OUT}$.

Accordingly, the dielectric filter has the same equivalent circuit as is shown in FIG. 7*b* to serve as a polar dielectric filter.

Consequently, the resonators provide a polar filter without using external parts such as metal terminals, interstage coupling capacitors and series resonance capacitor. This results in a reduce number of components and a decreased number of assembling steps, further diminishing the space needed for the installation of the filter in devices.

Further because the inner conductor layer of the resonator is capacitively coupled to the electrode thereof, the value of the coupling capacitance is variable easily by altering the shape or size of the electrode. The filter can therefore be readily given the desired pass characteristics.

Embodiment 3

Figure 4A:
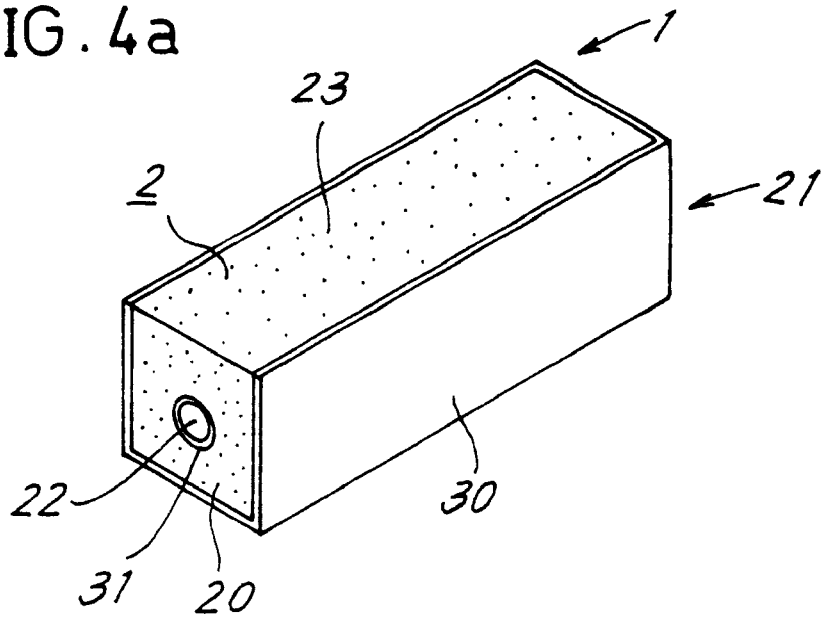
FIG. 4*a* is a perspective view showing a coaxial dielectric resonator for use in another polar dielectric filter as a third embodiment.
Figure 4B:
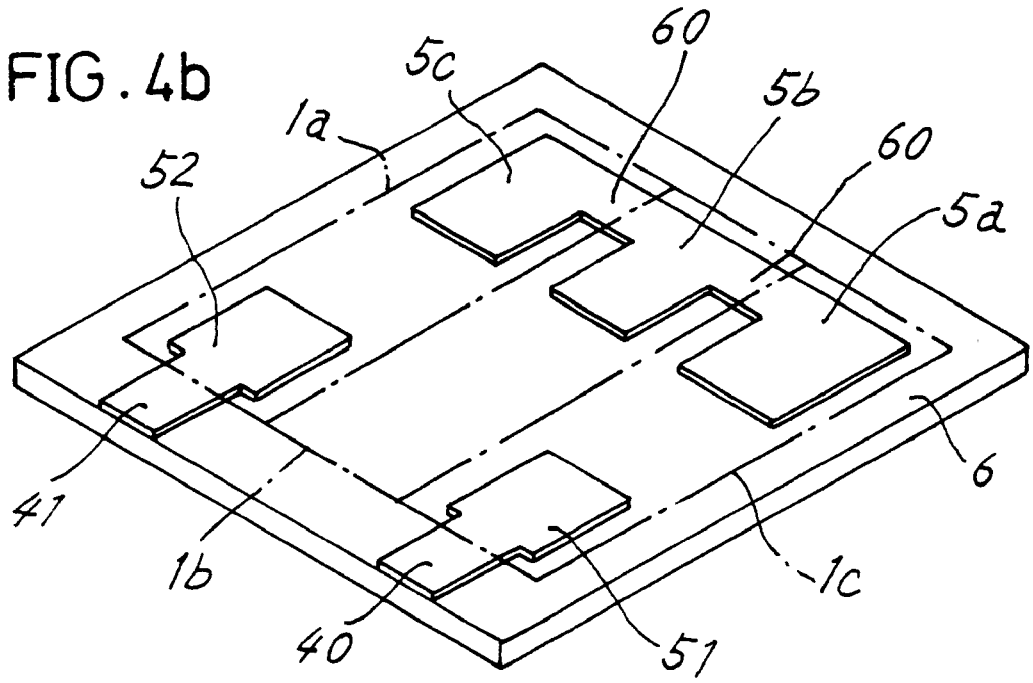
FIG. 4*b* is a perspective view showing a substrate for use in the third embodiment.

FIGS. 4*a* and 4*b* show a third embodiment, i.e., a dielectric filter which comprises coaxial dielectric resonators 1*a,* 1*b,* 1*c* having respective inner conductor layers 31, and a substrate 6 formed with electrodes 5*a,* 5*b,* 5*c,* 51, 52 capacitively coupled to the layers 31. The electrodes 5*a,* 5*b,* 5*c* are connected together by substantially straight conductor patterns 60, 60, and input and output electrodes 51, 52 are integral with the input and output terminal patterns 40, 41, respectively. The resonators 1*a,* 1*b,* 1*c* each have no outer conductor layer 30 on the bottom side 23.

The dielectric filter thus constructed has the same capacitance couplings as the second embodiment and therefore has the same equivalent circuit as is shown in FIG. 7*b* to serve as a polar dielectric filter. Thus, the filter has the same advantages as the second embodiment.

Embodiment 4

Figure 5A:
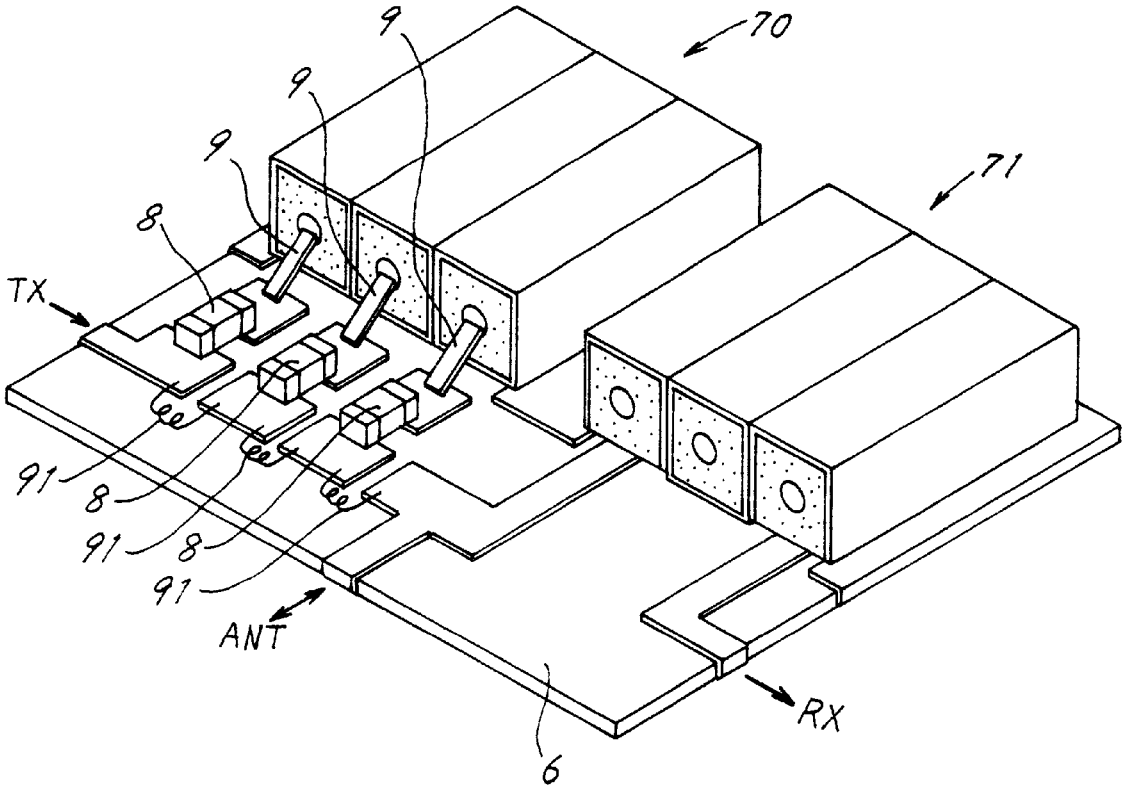
FIG. 5*a* is a perspective view showing a dielectric duplexer comprising the polar dielectric filter of the second embodiment.
Figure 5B:
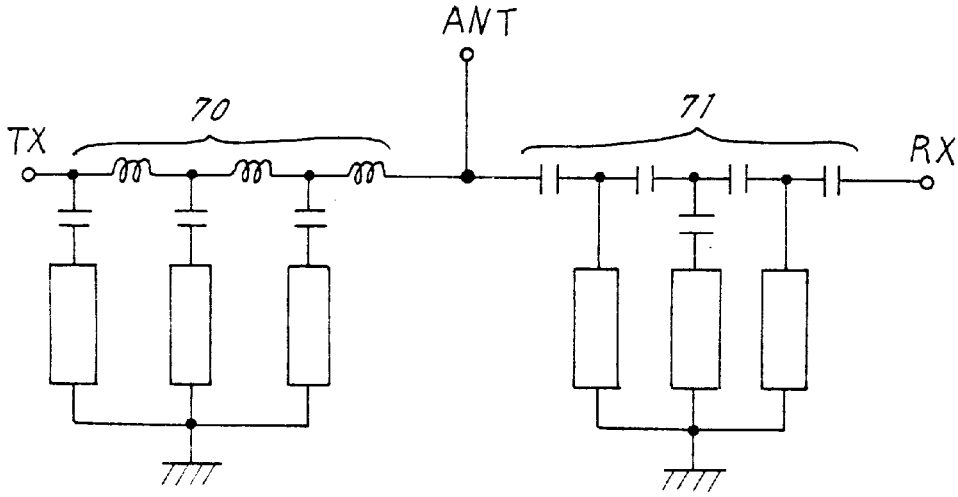
FIG. 5*b* is an equivalent circuit diagram of the duplexer shown in FIG. 5*a;*

This embodiment is a dielectric duplexer having the equivalent circuit shown in FIG. 5*b*. As seen in FIG. 5*a,* a transmitting dielectric filter 70 and a receiving dielectric filter 71 are arranged on a substrate 6. The dielectric filter of the second embodiment is used as the receiving dielectric filter 71 of this embodiment. The transmitting filter 70 is a conventional dielectric filter having external parts such as metal terminals 9, capacitors 8, coils 91, etc.

When attention is directed to the receiving filter 71, this embodiment, like the second embodiment, is smaller in the number of components than the corresponding device of the prior art and is apparently smaller also in size for use as a duplexer.

The coaxial dielectric resonators 1*a,* 1*b,* 1*c* of the foregoing embodiments are illustrated as adjoined to one another, whereas all the electrodes are capacitively coupled to the inner conductor layers 31 according to the invention, and the inner conductor layers of the resonators are not so coupled to one another as by interstage coupling windows, so that the resonators need not adjoin one another.

Figure 6:
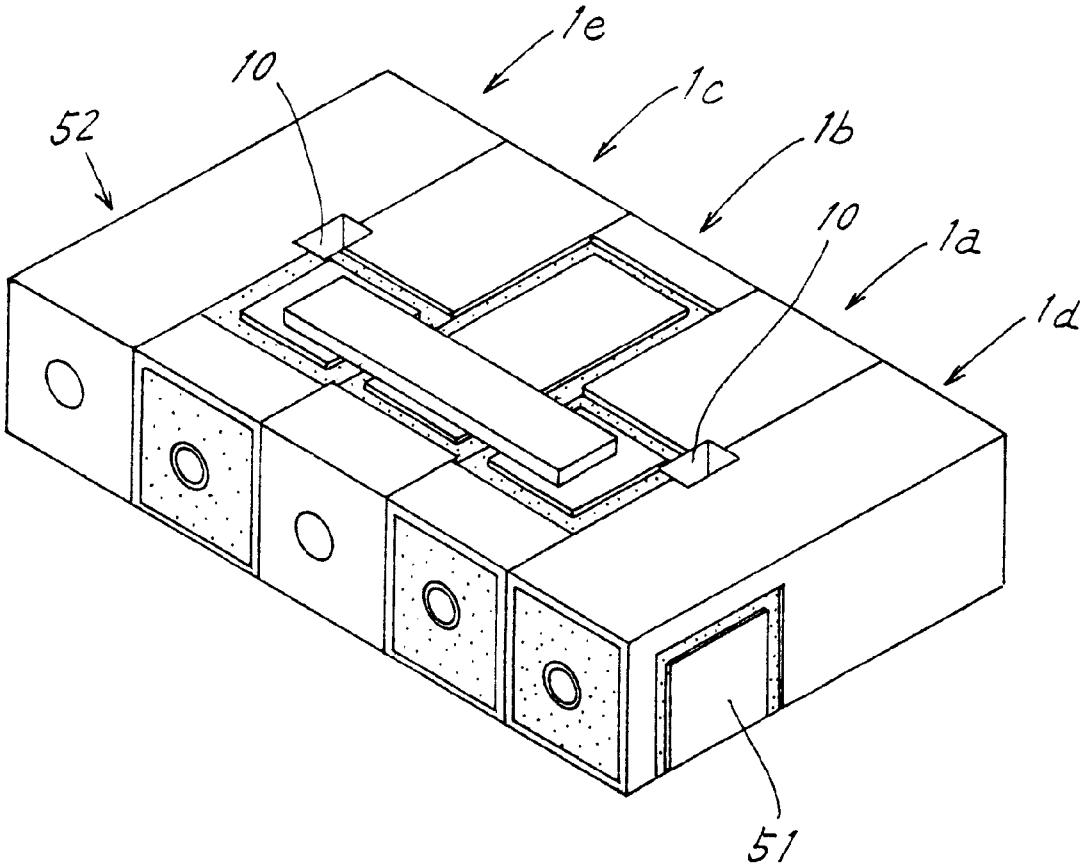
FIG. 6 is a perspective view showing a polar dielectric filter which comprises the filter of the first embodiment and two coaxial dielectric resonators coupled thereto through interstage coupling windows.

Although the present embodiment comprises three coaxial dielectric resonators 1*a,* 1*b,* 1*c,* coaxial dielectric resonators 1*d,* 1*e* can further be coupled to the resonators by other means such as interstage coupling windows 10 as shown in FIG. 6. In this case, the electrodes 51, 52 to be connected to external input and output terminals can be provided on the respective additional resonators 1*d,* 1*e* to use these resonators 1*d,* 1*e* as input and output stages.

Although there is no need to use external parts such as capacitors according to the invention, coils, capacitors and like external parts may be added to the device of the invention to obtain the desired pass characteristics.

The foregoing embodiments are intended to illustrate the present invention and should not be construed as limiting the invention set forth in the appended claims or reducing the scope thereof. Further the devices of the invention are not limited to the above embodiments in construction but can of course be modified variously within the technical scope set forth in the claims.

For example, the electrodes of the embodiments, although rectangular, can be altered as desired in size or shape insofar as the desired coupling capacitance is available.

The coaxial dielectric resonators 1*a,* 1*b,* 1*c* are so arranged that the open ends thereof face toward opposite directions alternately in the first embodiment, while the open ends face toward one direction in the second embodiment. Thus, the direction of the open ends of the resonators 1*a,* 1*b,* 1*c* can be determined as desired.

The input and output terminals 40, 41 of the dielectric filter are formed on the resonators 1*a,* 1*c* according to the first embodiment, whereas these terminals are arranged on the substrate 6 in the second and third embodiments. In this way, the input and output terminals 40, 41 can be selected as desired with respect to the position and shape. Similarly, known means is selectively usable as desired for capacitively coupling the inner conductor layers of the input-stage and output-stage resonators to the input and output terminals.

What is claimed is:

1. A polar band-pass dielectric filter comprising three coaxial dielectric resonators each including a main body in the form of a dielectric member, the main body being formed with a through bore extending through opposite end faces thereof, the main body having an outer conductor layer provided over an outer peripheral surface thereof and an inner conductor layer over an inner surface thereof defining the through bore, the resonators being joined to one another with one side of an outer periphery surface of each resonator serving as a joint surface, wherein each of the resonators includes an electrode insulated from the outer conductor layer and provided at a portion of the outer peripheral surface thereof other than the joint surface, each of the electrodes of the resonators being connected directly together by a non-inductive conductor member having a substantially straight form.

2. The polar band-pass dielectric filter according to claim 1, further comprising at least one electric element connected to the polar band-pass dielectric filter.

3. The polar band-pass dielectric filter according to claim 1, further comprising at least one additional coaxial dielectric resonator capacitively or inductively connected to the polar band-pass dielectric filter.

4. A dielectric duplexer having incorporated therein said polar band-pass dielectric filter according to claim 1.

5. A polar band-pass dielectric filter comprising three coaxial dielectric resonators each including a main body in the form of a dielectric member, the main body being formed with a through bore extending through opposite end faces thereof, the main body having an outer conductor layer provided over an outer peripheral surface thereof and an inner conductor layer over an inner surface thereof defining the through bore, the resonators being mounted on a substrate, wherein each of the resonators includes an electrode insulated from the outer conductor layer and provided at a portion of an outer peripheral surface of the resonator on the bottom side thereof in contact with the substrate, each of the electrodes of the resonators being connected directly together by a substantially straight non-inductive conductor pattern provided on the substrate.

6. The polar band-pass dielectric filter according to claim 5, further comprising at least one electric element connected to the polar band-pass dielectric filter.

7. The polar band-pass dielectric filter according to claim 5, further comprising at least one additional coaxial dielectric resonator capacitively or inductively connected to the polar band-pass dielectric filter.

8. A dielectric duplexer having incorporated therein said polar band-pass dielectric filter according to claim 5.

9. A polar band-pass dielectric filter comprising three coaxial dielectric resonators each including a main body in the form of a dielectric member, the main body being formed with a through bore extending through opposite end faces thereof, the main body having an outer conductor layer provided over an outer peripheral surface thereof and an inner conductor layer over an inner surface thereof defining the through bore, the resonators being mounted on a substrate, wherein each of the resonators has its outer conductor layer removed from a portion or the entire area of a bottom side thereof in contact with the substrate, the substrate being provided with electrode patterns on portions thereof in contact with the respective layer-removed portions of the resonators and a substantially straight non-inductive conductor pattern connecting each of the electrode patterns directly together.

10. The polar band-pass dielectric filter according to claim 9, further comprising at least one electric element connected to the polar band-pass dielectric filter.

11. The polar band-pass dielectric filter according to claim 9, further comprising at least one additional coaxial dielectric resonator capacitively or inductively connected to the polar band-pass dielectric filter.

12. A dielectric duplexer having incorporated therein said polar band-pass dielectric filter according to claim 9.

* * * * *